United States Patent [19]

Iwata et al.

[11] 4,267,482

[45] May 12, 1981

[54] IGNITION SPARK PLUG

[75] Inventors: Toshiharu Iwata, Aichi; Tadashi Hattori, Okazaki, both of Japan

[73] Assignee: Nippon Soken, Inc., Nishio, Japan

[21] Appl. No.: 892,137

[22] Filed: Mar. 31, 1978

[30] Foreign Application Priority Data

| | | | |
|---|---|---|---|
| Apr. 7, 1977 | [JP] | Japan | 52-40128 |
| Apr. 21, 1977 | [JP] | Japan | 52-46533 |
| Aug. 5, 1977 | [JP] | Japan | 52-94426 |

[51] Int. Cl.[3] ..... H01T 13/20

[52] U.S. Cl. ..... 313/143; 313/120

[58] Field of Search ..... 313/120, 132, 143

[56] References Cited

U.S. PATENT DOCUMENTS

| | | | |
|---|---|---|---|
| 1,607,747 | 11/1926 | Pognon | 313/143 |
| 2,064,738 | 12/1936 | Erny | 313/143 |
| 2,292,409 | 8/1942 | Steward | 313/120 X |
| 2,646,782 | 7/1953 | Fisher | 313/120 |
| 3,016,411 | 1/1962 | Fisher | 313/120 X |
| 4,015,161 | 3/1977 | Resler | 313/143 |

*Primary Examiner*—Palmer C. Demeo
*Assistant Examiner*—Darwin R. Hostetter
*Attorney, Agent, or Firm*—Cushman, Darby & Cushman

[57] ABSTRACT

A spark plug for internal combustion engines includes at least a part of communicating holes each having one end opened in the vicinity of a packing and the other end opened to an engine combustion chamber, whereby the propagation of the flame into the space defined by the outer surface of an insulator leg, the inner surface of a metal plug body and the packing is prevented.

3 Claims, 18 Drawing Figures

IGNITION SPARK PLUG

BACKGROUND OF THE INVENTION

The present invention relates to spark plugs for spark-ignition engines, and more particularly the invention relates to a spark plug having an improved resistance to carbon fouling.

It has been the tendency of the spark plugs known in the art to cause incomplete combustion due to the propagation of flame, thus causing a carbon deposition on the surface of the leg portion of the plug insulator and thereby causing insulation failure. This has also been confirmed by the fact that the degree of carbon fouling is increased as the ignition timing is advanced even if the other conditions are kept the same.

On the other hand, when the burning of the mixture in the combustion chamber becomes vigorous, the pressure in the combustion chamber is increased and at the same time the production of carbon within the combustion chamber is increased. This pressure rise in turn causes the burned gas to flow into the space of the spark plug and in this case there is the danger of causing the carbon produced in the combustion chamber to deposit on the surface of the insulator facing the space.

SUMMARY OF THE INVENTION

It is the object of this invention to provide a spark plug wherein a plurality of communicating holes are provided in a plug body or shell, each being open at one end to a space formed in the plug body and open at the other end to an engine combustion chamber, whereby the velocity of a fresh mixture flowing into the space is decreased by the fresh mixture introduced into the space through the communicating holes thus preventing the propagation of the initial flame into the space and moreover the introduction of the fresh mixture into the space through the communicating holes has the effect of decreasing the amount of the burned gas present within the space and thereby preventing carbon fouling.

BRIEF DESCRIPTION OF THE DRAWINGS

FIG. 1(*b*) is a bottom view of FIG. 1(*a*).

FIG. 2(*b*) is a bottom view of FIG. 2(*a*).

FIG. 3(*b*) is a bottom view of FIG. 3(*a*).

FIG. 7(*b*) is a sectional view taken along the line VII(*b*)-VII(*b*) of FIG. 7(*a*).

FIG. 8(*b*) is a bottom view of FIG. 8(*a*).

FIG. 8(*c*) is a sectional view taken along the line VIII(*c*)-VIII(*c*) of FIG. 8(*a*).

FIG. 9(*b*) is a bottom view of FIG. 9(*a*).

FIG. 10(*b*) is a sectional view taken along the line X(*b*)-X(*b*) of FIG. 10(*a*).

DESCRIPTION OF THE PREFERRED EMBODIMENTS

Figure 1A:
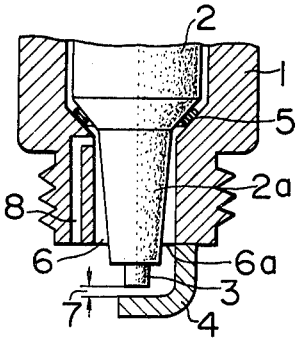
FIG. 1(*a*) is a sectional view showing the principal parts of a first embodiment of a spark plug according to the present invention.
Figure 1B:
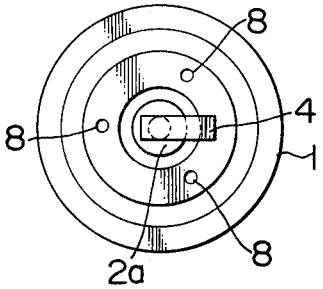

Referring to FIGS. 1(*a*) and 1(*b*), a first embodiment of the invention will now be described. In the Figures, an insulator 2 is fixedly positioned inside a metal plug body or shell 1 through the intermediary of a ring-shaped metal packing 5. A center electrode 3 is mounted fixedly in a leg portion 2*a* of the insulator 2 which is exposed to the inside of an engine combustion chamber (not shown). Disposed opposite to the forward end of the center electrode 3 is the end side of a ground electrode 4 fixed to the end of the plug body 1, and a spark gap 7 is provided between the two electrodes. A space portion 6 is defined by the leg portion 2*a* of the insulator 2, the plug body 1 and the packing 5 and it opens to the combustion chamber in the direction of the spark gap 7. The plug body 1 is formed with communicating holes 8 each of which opens at one end to the inner part of the space portion 6 near the packing 5 and opens at the other end to the inside of the combustion chamber.

With the construction described above, the operation of the first embodiment is as follows. There exist the following two conditions within the space portion 6, namely, (a) the condition which allows mixing with a fresh mixture of a comparatively large amount of the burned gas produced by the previous cycle and (b) the combustion heat tends to be taken away by the plug body enclosing the space portion 6, and consequently the propagation of a relatively low temperature initial flame into the space portion 6 under such conditions will cause incomplete combustion and hence carbon fouling. If the deposition of carbon on the leg portion 2*a* extends to near the packing 5, the current flow from the center electrode 3 will leak to the plug body 1 through the carbon deposits and the packing 5 and no spark will jump across the spark gap 7, thus causing misfiring.

With the present embodiment, however, during the compression stroke of the engine a fresh mixture is spouted and introduced through the communicating holes 8 into the space portion 6 near the packing 5 and the burned gas exists within the space portion 6, thus decreasing the velocity of the fresh mixture flowing into the space portion 6 through its open end 6*a*. Thus, during the initial period of the ignition, there is practically no possibility of the initial flame propagating and developing in the direction of the space portion 6. Even if the initial flame propagates into the space portion 6, by virtue of the fact that the fresh mixture is present in the space portion 6 near the packing 5, incomplete combustion is difficult to occur in the space portion 6 near the packing 5 and carbon deposition is difficult to occur on the inner part of the insulator 2 including the packing 5, thus making it difficult for misfiring to occur.

While, in the embodiment described above, it is preferable that the air flow resistance of the communicating holes 8 is lower than that of the open end 6*a* of the space portion 6, this is not a limiting factor to the first embodiment.

Figure 2A:
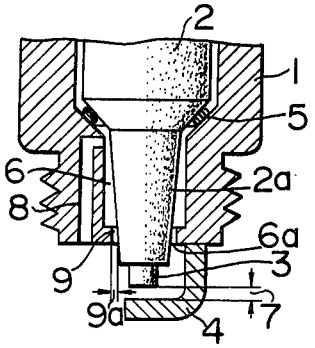
FIG. 2(*a*) is a sectional view showing the principal parts of a second embodiment of the spark plug according to the invention.
Figure 2B:
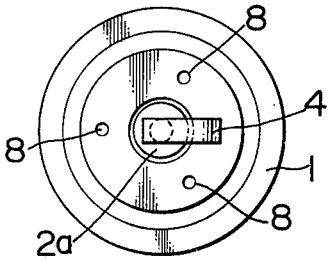

Next, a second embodiment of the invention will be described with reference to FIGS. 2(*a*) and 2(*b*). The second embodiment is identical in basic construction with the spark plug according to the embodiment of FIGS. 1(*a*) and 1(*b*) except that an annular restrictor section 9 is formed integral with the end of the plug body 1 to reduce the opening area of the open end 6*a* of the space portion 6. In this embodiment, during the compression stroke, the provision of the restrictor member 9 has the effect of making it difficult for a fresh mixture to flow through a restriction gap 9*a* (the open end of the space portion 6) between the leg portion 2*a* of the insulator 2 and the restrictor section 9 and the fresh mixture is spouted and introduced through the communicating holes 8 of the plug body 1 into the space portion 6 near the packing 5. As a result, the burned gas remaining within the space portion 6 is forced by the fresh mixture introduced into the space portion 6 to stay within the space portion 6 near the restriction gap 9*a*, so that even if the introduced fresh mixture is mixed with the burned gas within the space portion 6 thus causing an incomplete combustion in a portion thereof, the screening action of the burned gas staying in the space portion 6 near the restriction gap 9*a* prevents the propagation of the initial flame by way of the restriction gap 9*a* or the open end 6*a* of the space portion 6. On the other hand, the restrictor section 9 increases the amount of the fresh mixture introduced into the space portion 6 through the communicating holes 8 thus improving the combustion conditions within the space portion 6. Also at the restriction gap 9*a*, the heat is taken away through the restrictor section 9 with the result that even if the initial flame propagates to the restriction gap 9*a*, the initial flame is subjected to extinguishing action thus making it more difficult for the initial flame to propagate into the space portion 6. Thus, the second embodiment is more effective in preventing the propagation of initial flame than the first embodiment of the invention.

While, in both of the embodiments, the flame also propagates into the space portion 6 when the combustion stroke proceeds further from the initial combustion stage so that the mixture is burned vigorously within the combustion chamber and the pressure therein is increased, in this case there is no danger of carbon fouling owing to the high flame temperature.

The multi-gap spark plugs known in the art have been used in the engines of the type employing lean mixtures, engines with sub-chambers, rotary piston engines, etc., which have poor ignition properties and tendency to cause carbon fouling, and the present invention may be very advantageously incorporated in such multi-gap spark plugs.

Figure 3A:
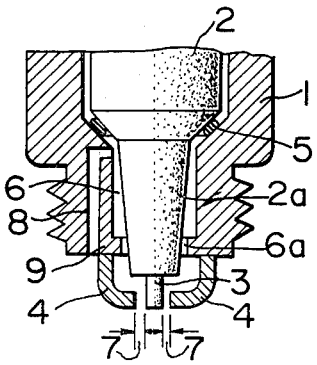
FIG. 3(*a*) is a sectional view showing the principal parts of a third embodiment in which the second embodiment of the invention is incorporated in a multi-gap spark plug.
Figure 3B:
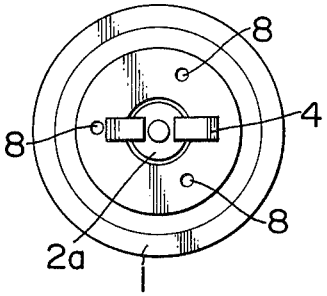

FIGS. 3(*a*) and 3(*b*) illustrate a third embodiment of the invention in which the second embodiment of the invention is incorporated in a multi-gap spark plug. In the Figure, the same component parts as used in the second embodiment are designated by the same reference numerals, and the third embodiment will not be described in any detail since its functions and effects are the same with the second embodiment.

While, in the embodiments described above, the restrictor section 9 is formed integral with the inner side of the end of the plug body 1, its position is not limited to the plug body end and the restrictor section 9 may be provided at a position inwardly of the end of the plug body 1. In this case, the open end 6*a* of the space portion 6 means the open end portion near the restrictor section 9.

Further, the restrictor section 9 need not be formed into an annular shape, and therefore the annular restrictor section 9 may be formed with a plurality of kerfs.

Figure 4:
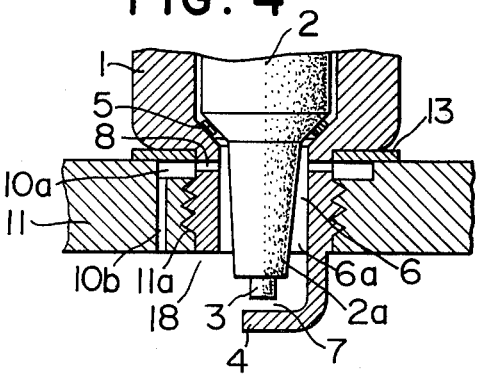
FIG. 4 is a sectional view showing the principal parts of a fourth embodiment of the invention.

Referring now to FIG. 4, there is shown a fourth embodiment of the invention. An insulator 2 is fixedly positioned inside a metal plug body 1 through the intermediary of a ring-shaped metal packing 5. A center electrode 3 is fixedly mounted in a leg portion 2*a* of the insulator 2 which is exposed to the inside of a combustion chamber 18 of an internal combustion engine. Disposed opposite to the forward end of the center electrode 3 is the end side of a ground electrode 4 fixed to the end of the plug body 1, and a spark gap 7 is provided between the electrodes. A space portion 6 is defined by the leg portion 2*a* of the insulator 2, the plug body 1 and the packing 5, and the space portion 6 opens to the combustion chamber 18 in the direction of the spark gap 7. The plug body 1 is formed with communicating holes 8 each of which opens at one end to the inner part of the space portion 6 near the packing 5 and open at the other end to the outside of the plug body 1. Also a ring-shaped ventilation groove 10*a* is formed in an engine cylinder wall 11 in which the spark plug constructed as mentioned above is fitted through the intermediary of a packing 13, and a vertical hole 10*b* is also formed in the cylinder wall 11 which opens at one end to the combustion chamber 18 and opens at the other end to the ventilation groove 10*a*. One side of the ventilation groove 10*a* opens to a spark plug mounting portion 11*a* of the cylinder wall 11 and communicates with ends of the communicating holes 8 in the plug body 1. As a result, the combustion chamber 18 is communicated with the space portion 6 through the communicating holes 8, the ventilation 10*a* and the vertical hole 10*b*.

With the construction described above, the operation of the fourth embodiment is as follows. There exist the following two conditions within the space portion 6, namely, (a) the condition which allows mixing with a fresh mixture of a comparatively large amount of the burned gas resulting from the previous cycle and (b) the combustion heat tends to be taken off by the plug body enclosing the space portion 6, and consequently the propagation of a relatively low temperature initial flame into the space portion 6 under these conditions will cause incomplete combustion and hence carbon fouling. If the deposition of carbon on the leg portion 2*b* extends to near the packing 5, the current flow from the center electrode 3 will leak to the plug body 1 through the carbon deposits and the packing 5 and no spark will jump across the spark gap 7, thus causing misfiring.

With the present embodiment, however, during the compression stroke a fresh mixture is spoutted and introduced into the space portion 6 near the packing 5 through the vertical hole 10*b*, the ventilation groove 10*a* and the communicating holes 8 and also the burned gas is present within the space portion 6, thus decreasing the flow velocity of the fresh mixture flowing into the space portion 6 through its open end 6*a*. As a result, during the initial period of the ignition there is practically no possibility of the initial flame propagation and developing along with the fresh mixture flow in the direction of the space portion 6. Thus, even if the initial flame propagates into the space portion 6, by virtue of the fresh mixture existing in the space portion 6 near the packing 5, there is an atmosphere which tends to prevent the occurrence of incomplete combustion in the vicinity of the packing 5, thus making the production of carbon difficult at the inner part of the insulator 2 including the packing 5 and thereby making the occurrence of misfiring difficult.

While, with this embodiment, it is desirable that the air flow resistance of the communicating holes 8, the ventilation groove 10*a* and the vertical hole 10*b* is lower than that of the open end 6*a* of the space portion 6, this is not a limiting factor to the present embodiment.

Figure 5:
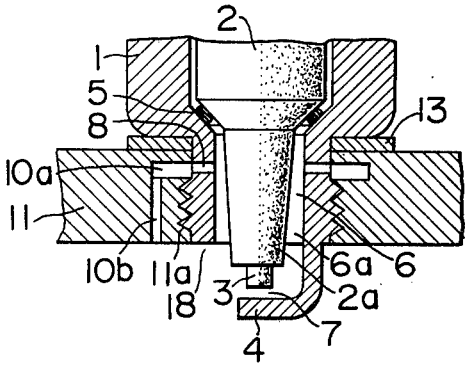
FIG. 5 is a sectional view showing the principal parts of a fifth embodiment of the invention.

FIG. 5 shows still another embodiment of the invention in which the ring-shaped ventilation groove 10*a* is provided inside the cylinder wall 11, and this embodiment is advantageous over the previously mentioned embodiments in that there is no need to seal the combustion gas by means of the packing 13.

Figure 6:
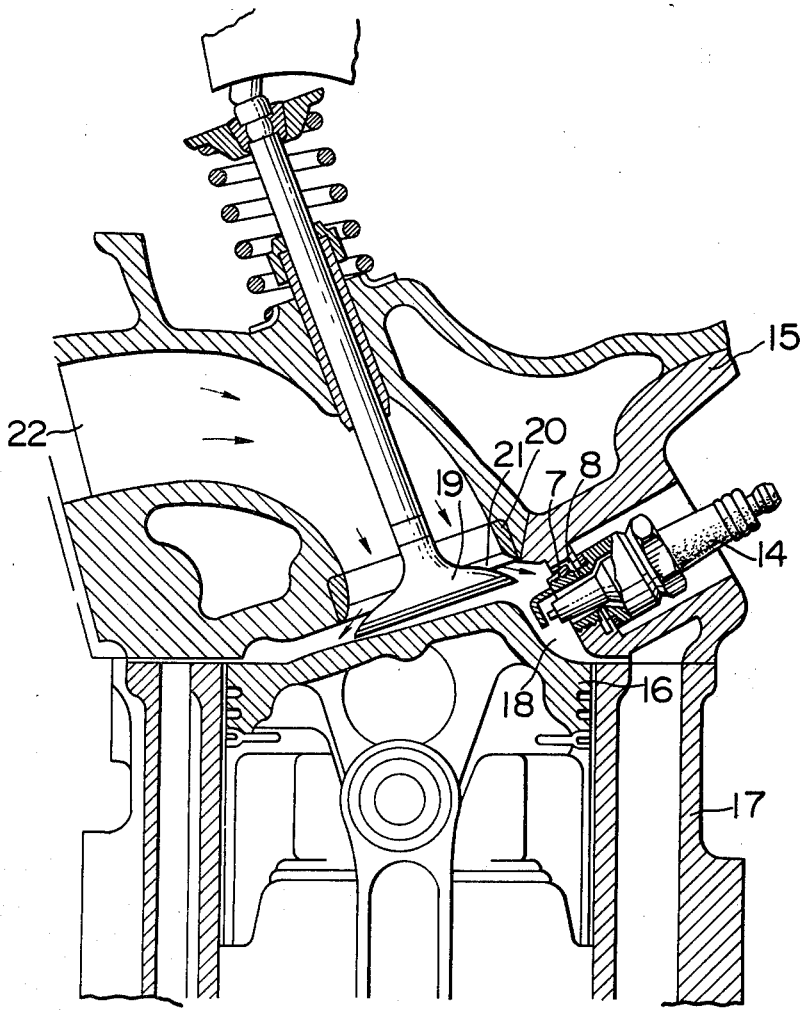
FIG. 6 is a sectional view showing the principal parts of a sixth embodiment of the invention.

With the embodiment shown in FIG. 6, the basic construction is identical with the construction of the spark plug and the cylinder wall 11 shown in FIG. 4 except that the end of the vertical hole 10*b* formed in the cylinder wall 11 is directed toward an intake valve port 21 which is provided when an intake valve 19 is opened (i.e., the gap between the intake valve 19 and a valve seat 20). In the Figure, numeral 14 designates a spark plug, 15 a cylinder head, 16 a piston, 17 a cylinder head, and 22 an intake port provided in the cylinder head 15.

With the construction described above, during the intake stroke the piston 16 moves downward and a fresh mixture is drawn into the combustion chamber 18 through the intake port 22 and through the intake valve port between the intake valve 19 and the valve seat 20. In this case, the fresh mixture flows in the direction of the arrows in FIG. 6, and particularly in the vicinity of the intake valve 19 the fresh mixture flows through the intake valve port 21 along the intake valve 19 in the direction perpendicular to the circumference of the intake valve 19. As a result, the fresh mixture flows efficiently into the vertical hole 10*b* of the cylinder wall 11 so that the burned gas remaining in the space portion 6 of the spark plug 14 is discharged with the resulting improvement in ventilation and the space portion 6 is filled with the fresh mixture, thus improving the combustion atmosphere within the space portion 6 and thereby ensuring considerably improved carbon fouling preventing effect.

With the embodiments described above, an annular restrictor may be provided on the inner side of the plug body 1 so as to reduce the opening area of the open end 6*a* of the space portion 6. With this construction, during the compression stroke the amount of fresh mixture introduced into the space portion 6 of the spark plug through the vertical hole 10*b*, the ventilation groove 10*a* and the communicating hole 8 is increased and at the same time the flow velocity of the fresh mixture through the open end 6*a* of the space portion 6 is decreased considerably, thus positively preventing the propagation of the initial flame.

The multi-gap spark plugs have been used in the engines of the type employing lean mixtures, engines with sub-chambers, rotary piston engines, etc., which have poor ignition properties and tendency to cause carbon fouling in preference to the ordinary spark plugs, and the present invention may be very advantageously incorporated in such multi-gap spark plugs.

Further, while in the embodiments described above, the number of the vertical hole 10*b* provided in the cylinder wall 11 is one, a plurality of such vertical holes may be provided. In this case, it is of course necessary that the number of ventilation groove 10*a* as well as the number of communicating hole 8 is determined correspondingly. Of course, the vertical hole 10*b* may be formed into a ring-shape as the ventilation groove 10*a*.

Figure 7A:
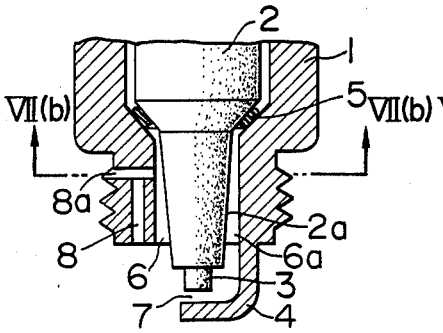
FIG. 7(*a*) is a sectional view showing the principal parts of a seventh embodiment of the spark plug according to the invention.
Figure 7B:
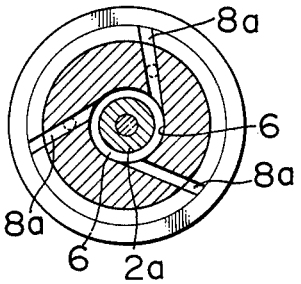

In the seventh embodiment shown in FIGS. 7(*a*) and 7(*b*), an insulator 2 is fixedly positioned inside a metal plug body 1 through the intermediary of a ring-shaped metal packing 5. A center electrode 3 is fixedly mounted in a leg portion 2*a* of the insulator 2 which is exposed to the inside of the engine combustion chamber (not shown). Disposed opposite to the forward end of the center electrode 3 is the end side of a ground electrode 4 fixed to the end of the plug body 1, and a spark gap 7 is provided between the electrodes. A space portion 6 is defined by the leg portion 2*a* of the insulator 2, the plug body 1 and the packing 5 and it opens to the inside of the combustion chamber in the direction of the spark gap 7. The plug body 1 is formed with a plurality of communicating holes 8 each of which opens at one end to the inner part of the space portion 6 near the packing 5 and opens at the other end to the combustion chamber. A transverse hole portion 8*a* is provided at one end of each communicating hole 8 which opens to the space portion 6 and these transverse hole portions 8*a* are directed tangential to the space portion 6 as shown in FIG. 7(*b*).

With the construction described above, the operation of this embodiment is as follows. There exist the following two conditions within the space portion 6, namely, (a) a condition which allows mixing of a fresh mixture, with a relatively large amount of the burned gas resulting from the previous cycle and (b) a condition in which combustion heat tends to be taken away by the plug body 1 enclosing the space portion 6, and the propagation of a relatively low temperature initial flame into the space portion 6 under these conditions will cause incomplete combustion and hence carbon fouling. If the deposition of carbon on the leg portion 2*a* extends too near the packing 5, the current flow from the center electrode 3 will leak to the plug body 1 through the carbon deposits and the packing 5 and no spark will jump across the spark gap 7, thus causing misfiring.

In the case of the present embodiment, however, during the compression stroke of the engine a fresh mixture is spouted and introduced by way of the communicating holes 8 into the space portion 6 near the packing 5 and also the burned gas is present within the space portion 6, thus decreasing the flow velocity of the fresh mixture flowing into the space portion 6 through its open end. As a result, during the initial period of the ignition there is practically no danger of the initial flame propagating and developing in the direction of the space portion 6. Even if the initial flame propagates into the space portion 6, by virtue of the fresh mixture present in the space portion 6 near the packing 5, there is less possibility of incomplete combustion occurring in the vicinity of the packing 5, thus lessening the danger of carbon depositing on the inner part of the insulator 2 and thereby lessening the danger of misfiring.

On the other hand, the transverse hole portions 8*a* of the communicating holes 8 are tangentially opened to the space portion 6 with the result that the fresh mixture spouted into the space portion 6 through the communicating holes 8 whirls in a spiral form within the space portion 6 and thus mixing of the fresh mixture with the burned gas of the previous cycle is facilitated, thus improving the combustion conditions within the space portion 6. This also has the effect of preventing the production of carbon. Moreover, when the burning of the mixture within the combustion chamber becomes vigorous and the pressure therein increases thus causing the carbon produced within the combustion chamber to be entrained on the burned gas flowing into the space portion 6, the tangential flow of the mixture through the transverse hole portions 8*a* causes a whirling stream around the leg portion 2*a* of the insulator 2 within the space portion 6 with the result that the carbon particles of greater specific gravity are gathered on the outer side in the burned gas and are thus deposited on the plug body 1, thus preventing carbon fouling of the leg portion 2*a* of the insulator 2 and thereby preventing misfiring and improving the ignition properties.

Figure 8A:
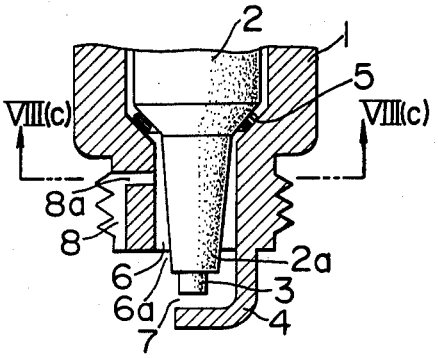
FIG. 8(*a*) is a sectional view showing the principal parts of an eighth embodiment of the invention.
Figure 8B:
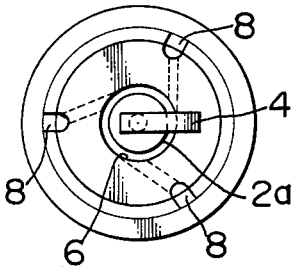
Figure 8C:
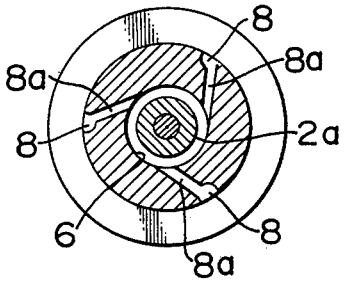

FIGS. 8(*a*), 8(*b*) and 8(*c*) show an eighth embodiment of the invention in which partially grooved communicating holes 8 are formed in a threaded section 1*a* of a plug body 1, and this embodiment is advantageous over the seventh embodiment in that the processing of the communicating holes 8 is easier and the passage cross-sectional area of the communicating holes can be made greater.

Figure 9A:
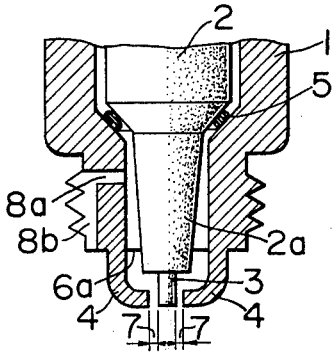
FIG. 9(*a*) is a sectional view showing the principal parts of a ninth embodiment in which the eighth embodiment of the invention is incorporated in a conventional multi-gap spark plug.
Figure 9B:
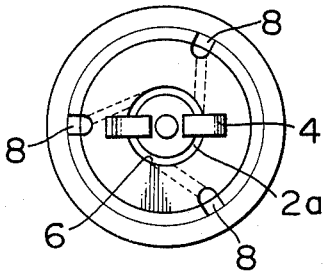

FIGS. 9(*a*) and 9(*b*) show ninth embodiment of the invention in which the eighth embodiment of the invention is incorporated in a known type of multi-gap spark plug. This embodiment will not be described in any detail, since the same component parts are designated by the same reference numerals and the functions and effects are the same with the eighth embodiment.

Figure 10A:
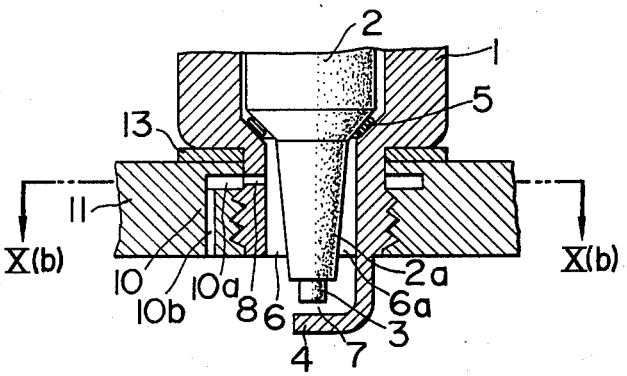
FIG. 10(*a*) is a sectional view showing the principal parts of a tenth embodiment of the invention.
Figure 10B:
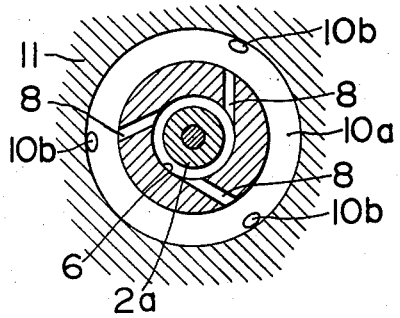

FIGS. 10(*a*) and 10(*b*) show a tenth embodiment of the invention which differs from the previously mentioned embodiments in that communicating holes 8 corresponding to the transverse hole portions 8*a* are provided in the plug body 1, that a connecting hole 10 including a transverse hole 10*a* and vertical holes 10*b* is provided in the cylinder wall 11 in which the plug body 1 is fitted and that the space portion 6 is communicated with the combustion chamber through this connecting hole 10 and the communicating holes 8 in the plug body 1.

The present invention is not intended to be limited to the embodiments described hereinabove, for example, inwardly projecting restriction projections may be provided on the side of the plug body 1 which faces the open end 6*a* of the space portion 6. In this case, the opening area of the open end 6*a* of the space portion 6 is reduced by the restriction projections, thus making difficult the passage of fresh mixture into the space portion 6 through the open end and thereby ensuring prevention of the propagation of initial flame into the space portion.

We claim:

1. A spark plug for use with a spark ignition-type internal combustion engine which has a combustion chamber, said spark plug comprising:

a tubular metal plug body having a longitudinal bore with an open end;

an insulator having a leg portion extending centrally within said plug body and out through said open end;

a ring of packing mounted in said plug body distally of said open end, said insulator leg portion extending through said ring of packing and being supported upon said plug body via said ring of packing material;

said plug body bore, axially outwardly of said ring of packing to said open end being radially oversize relative to said insulator leg portion axially outwardly of said ring of packing to said open end, thereby defining an annular space within said plug body bore, extending from said ring of packing to said open end;

a center electrode extending from within said insulator leg portion to axially outwardly of said open end so as to be directly exposed, in use, to said combustion chamber;

a ground electrode mounted on said plug body and extending therefrom axially outwardly of said open end and laterally into gapped adjacency with said center electrode; and means defining at least one passageway formed in said plug body, said at least one passageway having one end thereof positioned for open communication, in use, with said engine combustion chamber and having another end thereof in open communication with said annular space adjacent said ring of packing, so that during the running of the engine, the velocity of fresh combustible gas mixture flowing into said annular space through said open end is decreased due to the opposing introduction of fresh combustible gas mixture into said annular space through said passageway, thus decreasing the propagation of flame and the production of incompletely burned gas within said space and thereby decreasing carbon fouling of said spark plug;

said at least one passageway including a first axially extending portion that is eccentrically located relative to the longitudinal axis of said plug body and a second portion that extends substantially transversally relative to said longitudinal axis;

said first portion having said passageway one end;

said second portion having said passageway other end and intersecting said annular space substantially tangentially of a circumference of said annular space; and said first portion intersecting said second portion intermediate said one end and said other end of said passageway, so that the burned gas including carbon particles entering said annular space via said passageway vortically whorls within said annular space and such of these carbon particles as become deposited on said spark plug within said annular space are caused by centrifugal force to non-foulingly deposit on the plug body, away from said leg portion of said insulator.

2. The spark plug of claim 1 wherein said at least one passageway is constituted by a plurality of replicated ones thereof, angularly spaced from one another about said plug body.

3. The spark plug of claim 1 wherein said at least one passageway is enclosed, in use, by said plug body and said internal combustion engine except at said one end and at said other end of said at least one passageway.

* * * * *